United States Patent [19]

Graf

[11] Patent Number: 5,065,511

[45] Date of Patent: Nov. 19, 1991

[54] METHOD OF MOUNTING SAW-TOOTH WIRES ONTO A ROLLER FOR TEXTILE MACHINES

[75] Inventor: Ralph Graf, Freienbach, Switzerland

[73] Assignee: Graf & Cie AG, Rapperswil, Switzerland

[21] Appl. No.: 681,182

[22] Filed: Apr. 5, 1991

[30] Foreign Application Priority Data

Jun. 26, 1990 [CH] Switzerland ..... 2128/90

[51] Int. Cl.[5] ..... B21H 1/14

[52] U.S. Cl. ..... 29/895.211; 29/121.4; 29/127

[58] Field of Search ..... 29/895.211, 895.3, 121.4, 29/127

[56] References Cited

U.S. PATENT DOCUMENTS

| | | | |
|---|---|---|---|
| 425,087 | 4/1890 | Sargent | 29/895.211 X |
| 542,605 | 7/1895 | Clay et al. | 29/895.211 X |
| 3,740,809 | 6/1973 | Wolstencroft | 29/895.211 |
| 4,192,050 | 3/1980 | Appenzeller | 29/895.211 |
| 4,272,865 | 6/1981 | Schmolke | 29/121.4 X |
| 4,291,473 | 9/1981 | Yoshizawa et al. | 29/121.4 X |
| 4,342,137 | 8/1982 | Ennis et al. | 29/121.4 X |
| 4,352,224 | 10/1982 | Grimshaw et al. | 29/121.4 X |
| 4,903,385 | 2/1990 | Schmolke | 29/127 X |

*Primary Examiner*—Timothy V. Eley
*Assistant Examiner*—C. Richard Martin
*Attorney, Agent, or Firm*—Ladas & Parry

[57] ABSTRACT

A sinusoidally extending groove is cut into the jacket of a roller having a smooth surface to extend in circumferential direction thereof. A flat wire is thereafter placed into the groove. Then, a first saw-tooth wire is connected to one side of the flat wire and wound around the roller. The first turn of the first saw-tooth wire is guided by the flat wire and the subsequent turns thereof are guided by the respective preceding turn. After the winding has been completed, the flat wire is removed and a second saw-tooth wire is wound around the opposite located section of the roller. For this winding, the first turn of the first saw-tooth wire is used as guide for the first turn of the second saw-tooth wire. This leads to an optimal distribution of the tips of the clothing on the roller and an improved quality of the handling or treating, respectively, of the fibres. The roller finds use in textile machines, e.g. carding machines, opening machines, scutchers, breaker cards, etc.

6 Claims, 1 Drawing Sheet

METHOD OF MOUNTING SAW-TOOTH WIRES ONTO A ROLLER FOR TEXTILE MACHINES

BACKGROUND OF THE INVENTION

1. Field of the Invention

The present invention relates to a method of mounting saw-tooth wires onto a roller for textile machines which is to be equipped with a card clothing.

Rollers equipped with a card clothing in the form of saw-tooth wires find application in a great variety of machines in the textile industry, for instance in carding machines, opening machines, scutchers, breaker cards, tearing machines, cleaning devices and so forth.

2. Description of the Prior Art

The fibre mass which is treated by such rollers having a saw-tooth clothing or saw-tooth card clothing, respectively, should be distributed as uniformly as possible. This calls for a random distribution of the points of the teeth of the saw-tooth wires forming the clothing. This random distribution of the tips of the teeth of the saw-tooth wires is however not achieved when proceeding in accordance with known methods of winding the saw-tooth wires around the rollers, because according to these known methods the distribution of the tips is at least in part a regular distribution such that so-called lanes prevail between the tips within which lanes the fibres are partly or at least not sufficiently exposed to the working of the tips. Attempts have been made to countermand this drawback by winding a plurality of adjacently located saw-tooth wires onto a given roller. These methods, however, did also not lead to the desired success.

SUMMARY OF THE INVENTION

Accordingly, it is a general object of the invention to provide a method of mounting saw-tooth wires onto a roller for textile machines, by means of which a random distribution of the tips of the saw-tooth wires is arrived at such that no lanes between the tips of the saw-tooth wires are formed.

A further object is to provide a method of mounting saw-tooth wires onto a roller for textile machines comprising the steps of mounting a guide member onto the roller along a circumferential area located distant from both ends thereof; of placing an end of at least one first saw-tooth wire section against one side of the guide member and connecting it thereto; of winding the at least one first saw-tooth wire section onto a first part of the roller adjacent mentioned side of the guide member to which the first saw-tooth wire section has been connected to, which winding is performed such that at least a section of the first turn of the winding is guided by the guide member and any subsequent turn of the winding is guided by at least a portion of a respective preceding turn thereof; of removing the guide member at least partly and of connecting an end of at least one second saw-tooth wire section to at least one section of the first turn of the respective first saw-tooth wire section; of winding the at least one second saw-tooth wire section around a second, as yet not wound section of the roller, which winding is performed such that at least a section of the first turn of the winding of the second saw-tooth wire section is guided by at least a section of the first turn of the first saw-tooth wire section and any subsequent turn of the winding of the second saw-tooth wire section is guided by at least a portion of a respective preceding turn thereof.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
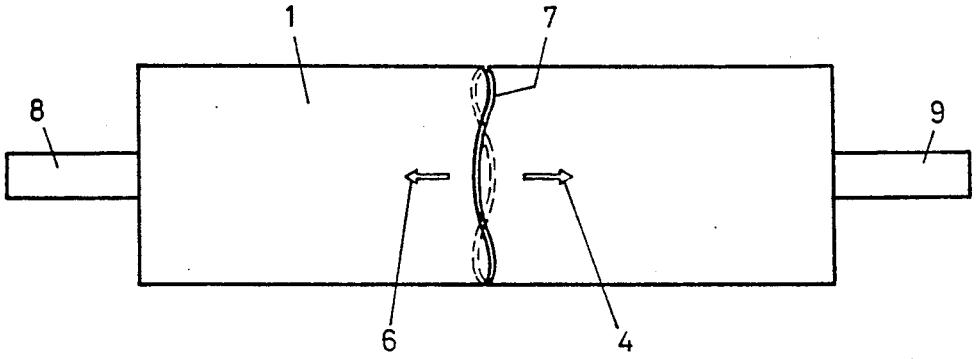
FIG. 1 is a schematic view of a roller having a smooth surface and which is to be equipped with saw-tooth wires and including a groove cut therein.

FIG. 1 illustrates a roller 1 having a smooth surface, which roller is to be equipped with saw-tooth wires, also commonly known under the term garniture. The axial length of this roller depends from its intended application, it can be actually longer or also shorter than this exemplary illustration. The body of this roller 1 may be a massive body or a hollow cylinder, even pipe-shaped. At both sides of the roller stub shafts 8, 9 are designed which support this exemplary roller 1 in bearings. Along a circumferential area located at the same distance from both ends of the roller a groove 7 is cut into the surface of the roller 1. This groove 7 extends such as illustrated in a sinusoidal fashion around the circumference of the roller and is closed in itself, that is an endless groove 7. In the here illustrated preferred embodiment only one groove 7 is indicated. Other designs foresee a plurality of such grooves 7 located at a mutual axial distance or it is also foreseen to have only one groove 7 which, however, is not equidistant from both ends of the roller 1.

Figure 2:
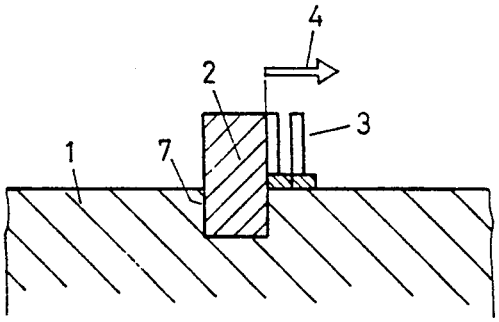
FIG. 2 illustrates schematically the initial step of mounting a first saw-tooth wire section.

After having cut this groove 7 into the roller 1, a flat wire 2 is placed into this groove 7 such as illustrated in FIG. 2, which flat wire 2 is arrested at various locations in the groove 7, for instance by means of a spot welding or a soldering.

Thereafter, a first saw-tooth wire section 3 is placed against one side of the flat wire 2 and connected thereto at least spotwise, which flat wire 2 is thereafter wound around the roller 1. This winding proceeds, such as illustrated in FIG. 2, around the right-hand section of the roller 1 and the direction of this winding is illustrated by means of the arrow 4. The first turn of the winding is guided by the flat wire 2 and the subsequent turns, that is those extending in the direction of the arrow 4, are guided by the respective previous turn and the winding proceeds in accordance with known procedures up to the so-called border wire, as is known in the art, and which is not particularly illustrated. Accordingly, the right half of the roller 1 has now been completely wound. Due to the sinusoidal extent of the flat wire 2 it is guaranteed that an absolute random distribution of the tips of the teeth of the saw-tooth wires is arrived at, which leads to the desired optimal distribution of the tips.

Figure 3:
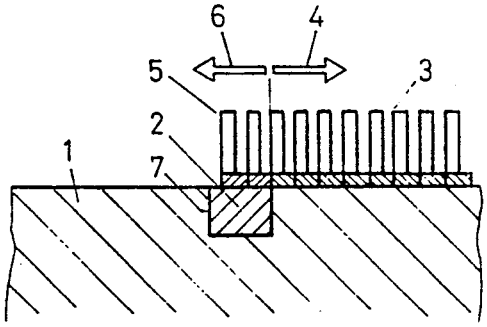
FIG. 3 illustrates schematically the mounting of a second saw-tooth wire section.

After above mentioned winding has been completed, the flat wire 2 located adjacent the first saw-tooth wire 3 is removed, because otherwise it could form an empty space, a lane extending along the circumference of the roller 1. This removing can proceed for instance as illustrated in FIG. 3 in that this flat wire 2 is machined down to the circumferential surface of the roller 1, for instance by a grinding procedure. The removing of this flat wire 2 can obviously also proceed by other technical measures.

Now, the winding of the second saw-tooth wire section 5 can begin. Its first turn is guided by the first turn of the first saw-tooth wire section 3 such that also this second saw-tooth wire section 5 extends in a sinusoidal fashion around the circumference of the roller. The winding of the second saw-tooth wire section 5 proceeds in the direction of the arrow 6 (see FIG. 3), whereby again every subsequent turn is guided by the respective preceding turn and the winding is made up to the left border wire. Now, the entire roller 1 is equipped with its clothing.

Figure 4:
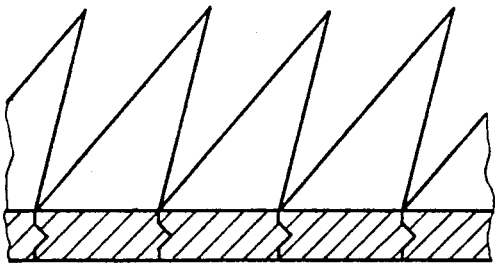
FIGS. 4 and 5 illustrate different shapes of saw-tooth wires.
Figure 5:
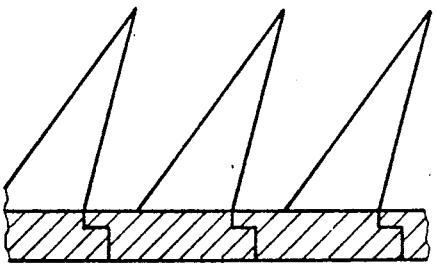

It is possible to use various designs of saw-tooth wires and specifically of their feet. It is for instance possible to use, such as illustrated in FIG. 3, interlinked saw-tooth wire sections or then, such as illustrated in FIG. 4, interlocked saw-tooth wire sections.

According to the above exemplary described embodiment there is only one single first saw-tooth wire section 3 and one single second saw-tooth wire section 5. Other embodiments foresee, however, to wind together a plurality of first saw-tooth wire sections 3 and a further plurality of second saw-tooth wire sections 5, respectively, parallel aside of each other onto the respective section of the roller. According to such design, only a respective section of a respective first saw-tooth wire section would be connected to a section of the flat wire 2, whereby subsequent turns of the individual saw-tooth wire sections would abut at the immediately adjacent plurality of parallel first saw-tooth wire sections. Accordingly, then also the plurality of second saw-tooth wire sections would be connected to only a section of the first saw-tooth wire section 3 and guided by this section which previously has contacted the removed flat wire 2. The further mutual guiding of the further turns of the plurality of second saw-tooth wire sections 5 would then proceed in accordance with the above described procedure, followed by winding the first saw-tooth wire sections 3. Accordingly, the roller 1 would then be wound at the area of the arrow 4 by a plurality of first saw-tooth wire sections 3 and the side indicated by the arrow 6 would be wound by a plurality of second saw-tooth wire sections 5, whereby then the respective turns would extend parallel relative to each other.

While there are shown and described present preferred embodiments of the invention, it is to be distinctly understood that the invention is not limited thereto, but may be otherwise variously embodied and practiced within the scope of the following claims.

I claim:

1. A method of mounting saw-tooth wires onto a roller for textile machines which is to be equipped with a card clothing, comprising the steps of providing a roller having a smooth surface;

of mounting a guide member onto the roller along a circumferential area located distant from both ends thereof;

of placing an end of at least one first saw-tooth wire section against one side of said guide member and connecting it thereto;

of winding said at least one first saw-tooth wire section onto a first part of said roller adjacent the mentioned side of the guide member to which said first saw-tooth wire section has been connected to, which winding is performed such that at least a section of the first turn of the winding is guided by said guide member and any subsequent turn of the winding is guided by at least a portion of a respective preceding turn thereof;

of removing said guide member at least partially and of connecting an end of at least one second saw-tooth wire section to at least one section of said first turn of the respective first saw-tooth wire section;

of winding said at least one second saw-tooth wire section around a second, as yet not wound section of said roller, which winding is performed such that at least a section of the first turn of the winding of said second saw-tooth wire section is guide by at least a section of the first turn of said first saw-tooth wire section and any subsequent turn of the winding of said second saw-tooth wire section is guided by at least a portion of a respective preceding turn thereof.

2. The method of claim 1, comprising the steps of placing an end of one single first saw-tooth wire section against one side of said guide member and connecting it thereto and winding said first saw-tooth wire section onto a first part of said roller adjacent mentioned side of the guide member to which said first saw-tooth wire section has been connected to, which winding is performed such that the first turn of the winding is completely guided by said guide member and any subsequent turn of the winding is guided by a respective preceding turn thereof;

that after said at least partially removing of said guide member the end of one single second saw-tooth wire section is connected to the first turn of said first saw-tooth wire section and winding said second saw-tooth wire section around a second, as yet not wound section of said roller, which winding is performed such that the first turn of the winding of the second saw-tooth wire section is guided completely by the first turn of said first saw-tooth wire section and any subsequent turn of the winding of said second saw-tooth wire section is guided by a respective preceding turn thereof.

3. The method of claim 1, wherein said circumferential area of said roller is located equidistant from both ends of the roller and wherein said guide member extends in a sinusoidal fashion around the circumference of said roller.

4. The method of claim 1, comprising further the step of cutting a circumferentially extending groove into said roller at said circumferential area and of placing an auxiliary wire into the cut groove, which auxiliary wire acts as guide member.

5. The method of claim 4, wherein said auxiliary wire has a flat cross-section.

6. The method of claim 1, wherein said saw-tooth wires are of an interlinking or of an interlocking design.

* * * * *